US006857912B2

(12) United States Patent
Wu

(10) Patent No.: US 6,857,912 B2
(45) Date of Patent: Feb. 22, 2005

(54) CABLE ASSEMBLY WITH INTERNAL CIRCUIT MODULES

(75) Inventor: Jerry Wu, Irvine, CA (US)

(73) Assignee: Hon Hai Precision Ind. Co., Ltd, Taipei Hsien ( * ) Notice: Subject to any disclaimer, the term of this patent is extended or adjusted under 35 U.S.C. 154(b) by 0 days.

(21) Appl. No.: 10/607,421

(22) Filed: Jun. 25, 2003

(65) Prior Publication Data

US 2004/0266273 A1 Dec. 30, 2004

(51) Int. Cl.[7] ..... H01R 13/502
(52) U.S. Cl. ..... 439/701
(58) Field of Search ..... 439/701, 607, 439/608, 497, 493, 579

(56) References Cited

U.S. PATENT DOCUMENTS

| | | | | |
|---|---|---|---|---|
| 5,924,899 A | | 7/1999 | Paagman | 439/701 |
| 6,102,747 A | | 8/2000 | Paagman | 439/701 |
| 6,217,364 B1 | | 4/2001 | Miskin et al. | 439/358 |
| 6,273,753 B1 | * | 8/2001 | Ko | 439/579 |
| 6,619,985 B1 | * | 9/2003 | Ko | 439/607 |
| 6,685,510 B1 | * | 2/2004 | Wu | 439/608 |
| 6,685,511 B2 | * | 2/2004 | Akama et al. | 439/610 |
| 6,699,072 B1 | * | 3/2004 | Wu | 439/608 |
| 6,699,074 B1 | * | 3/2004 | Wu et al. | 439/608 |
| 6,705,894 B1 | * | 3/2004 | Comerci et al. | 439/607 |

* cited by examiner

*Primary Examiner*—Thanh-Tam Le
(74) *Attorney, Agent, or Firm*—Wei Te Chung

(57) ABSTRACT

A cable assemble (1) for engaging a complementary connector includes an insulation housing (10), number of circuit modules (20) received in the housing, and a two-piece cover (30) cooperating with the housing for retaining the circuit modules. Each circuit module includes a circuit board (22) accommodated in the housing, a number of first cables (231) and second coaxial cables (232) electrically and mechanically connected to the circuit board. Each second cable includes a second conductive core (2320) soldered on one side of the circuit board, and a grounding plate (24) attached to an opposite side of the circuit board and electrically connecting with a metal braid (2322) covering the second conductive core of each second cable.

5 Claims, 9 Drawing Sheets

CABLE ASSEMBLY WITH INTERNAL CIRCUIT MODULES

CROSS-REFERENCE TO RELATED APPLICATIONS

Subject matter of this patent application is related to pending U.S. patent application Ser. Nos. 10/316,547, entitled "CABLE ASSEMBLY", filed on Dec. 10, 2002, Ser. No. 10/278,520, filed on Oct. 22, 2002 and entitled "ELECTRICAL CABLE CONNECTOR", and an unknown application entitled "CABLE ASSEMBLY WITH IMPROVED GROUNDING MEANS" filed Jun. 19, 2003, all of which are invented by Jerry Wu and assigned to the same assignee as this application.

BACKGROUND OF THE INVENTION

1. Field of the Invention

The present invention generally relates to a cable assembly, and particularly to a cable assembly having a plurality of circuit boards for high speed signal transmission.

2. Description of Related Art

With the development of communication and computer technology, high density electrical connectors are desired to construct a plurality of signal transmitting paths between two electronic devices. Each of these electrical connectors provides a plurality of circuit boards to thereby achieve improved signal transmission of different electrical characteristics through the connector. Such high density electrical connectors, such as cable assemblies, are widely used in internal connecting systems of severs, routers and the like requiring high speed data processing and communication.

U.S. Pat. No. 6,217,364, issued to Miskin et al., discloses a cable assembly including an insulating housing formed by a pair of substantially identical housing halves and an electrical cable with a plurality of wires terminated to conductive terminals overmolded in a plurality of thin flat wafers. The housing halves combine to define an interior cavity having a front opening and a rear opening. The wafers are closely juxtaposed in a parallel array and are positioned within the interior cavity of one of the housing halves such that the cable projects out of the rear opening of the cavity. The other housing half is then to completely enclose the cable and wafer subassembly. However, the cable and wafer subassembly are retained in the housing by securing the housing halves together through bolts and nuts, thereby complicating the assemblage of the cable assembly. Furthermore, an engagement of the housing halves is easy to become loose due to vibration during the transportation and other matters, whereby the cable and the wafer subassembly cannot be stably retained in the housing. Thus, an electrical connection is adversely affected between the cable assembly and a complementary connector.

U.S. Pat. Nos. 5,924,899 (the '899 patent) and 6,102,747 (the '747 patent), both issued to Paagman, each disclose a cable assembly. Referring to FIGS. 4*a*–4*c* and 5*a*–5*c* of the '899/'747 patent, the cable assembly includes an insulating housing with a plurality of parallel slots defined therein and a plurality of modules received in the slots of the housing. Each module includes a circuit substrate, a receptacle carrier having a plurality of fork contacts at one end of the substrate and an insulation displacement contact (IDC) carrier at the other end of the substrate opposite to the terminal carrier. The insulation displacement carrier has insulation displacement contacts connecting with conductors of corresponding cables each of which consists of a differential pair. The modules each are retained in the housing through an interference fit with the housing. When the cable assembly is required to disengage from a complementary connector, a pulling force is exerted on an exposed end of the cable for releasing the engagement between the cable assembly and the complementary connector. However, the modules may be pulled back with regard to the housing, thereby adversely affecting an electrical engagement when the cable assembly mates with the complementary connector again. Furthermore, an additional device is employed to bind the cables together, thereby increasing the cost of the production.

There also exists a need of transmitting different signals from a connector to a server or the like. The patents mentioned above do not satisfy this demand. Hence, an improved cable assembly is highly desired to overcome the disadvantages of the related art.

BRIEF SUMMARY OF THE INVENTION

Accordingly, it is an object of the present invention to provide a cable assembly having strain relief means for substantially resisting a pulling force exerted on a cable thereof.

It is another object of the present invention to provide a cable assembly transmitting different signals therethrough.

In order to achieve the above-mentioned objects, a cable assembly in accordance with the present invention for engaging with a complementary connector, comprises an insulating housing, a plurality of circuit modules received in the housing, and a two-piece cover cooperating with the housing for retaining the circuit modules. Each circuit module includes a circuit board accommodated in the housing, a number of first cables and a number of second single-ended coaxial cables mechanically and electrically connecting with the circuit board, a grounding plate attached to the circuit board, and a cable clamp for clamping the cables. Each single-ended coaxial cable comprises a second conductive core soldered to the circuit board and a braid surrounding the conductive core and soldering with the grounding plate.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
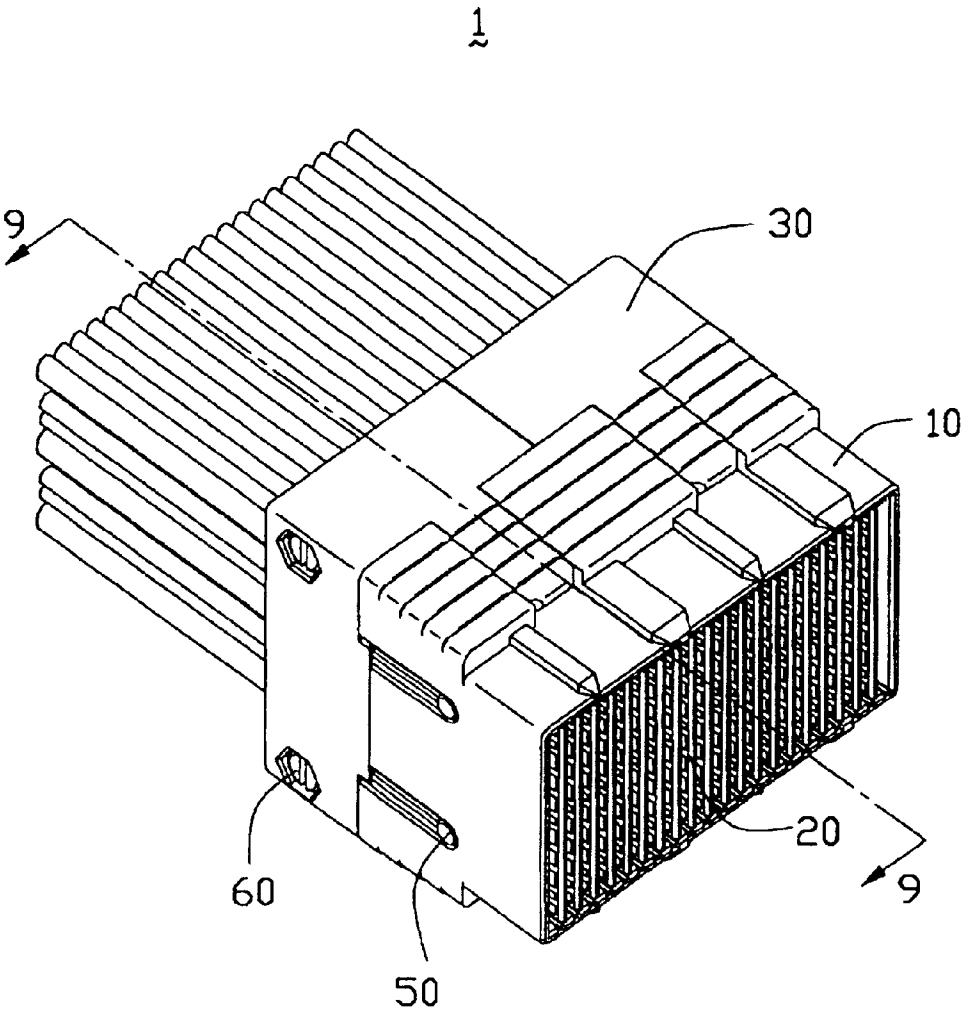
FIG. 1 is a perspective view of a cable assembly in accordance with the present invention.

Reference will now be made to the drawing figures to describe the present invention in detail.

Figure 2:
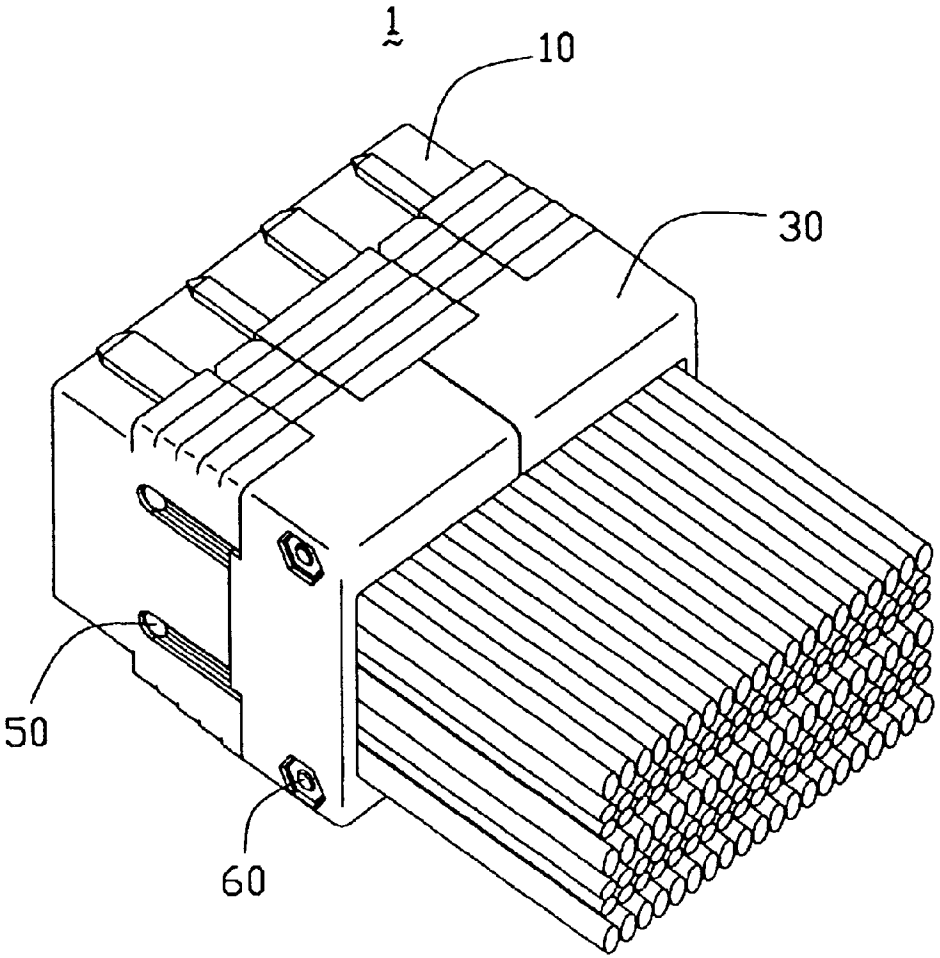
FIG. 2 is a view similar to FIG. 1, but taken from rear and bottom aspects.

With reference to FIGS. 1 and 2, a cable assembly 1 in accordance with the present invention comprises a front insulating housing 10, a plurality of circuit modules 20 received in the front insulating housing 10, and a two-piece rear cover 30 together engaged with the front insulating housing 10 for retaining the circuit modules 20.

Figure 3:
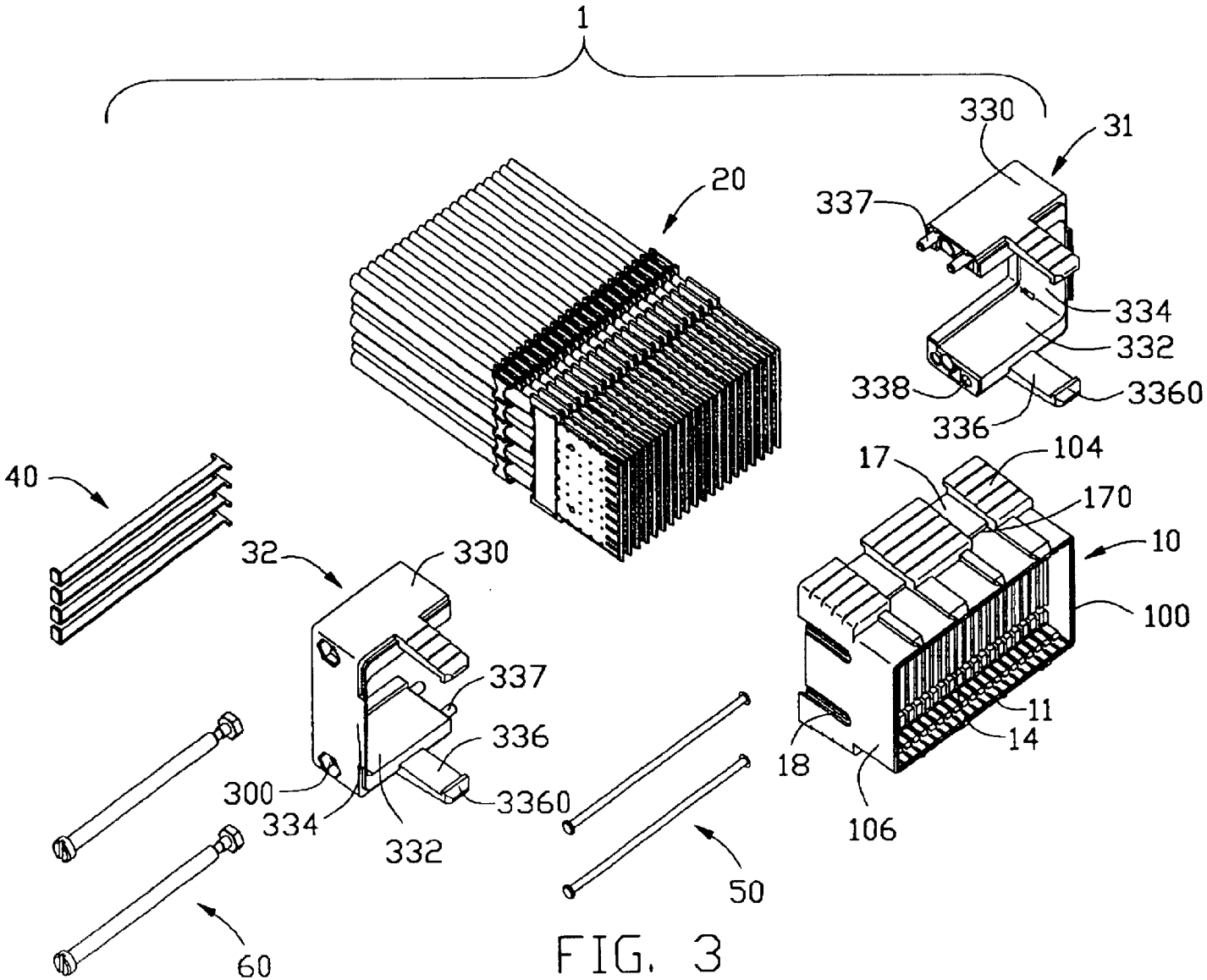
FIG. 3 is an exploded, perspective view of the cable assembly.
Figure 4:
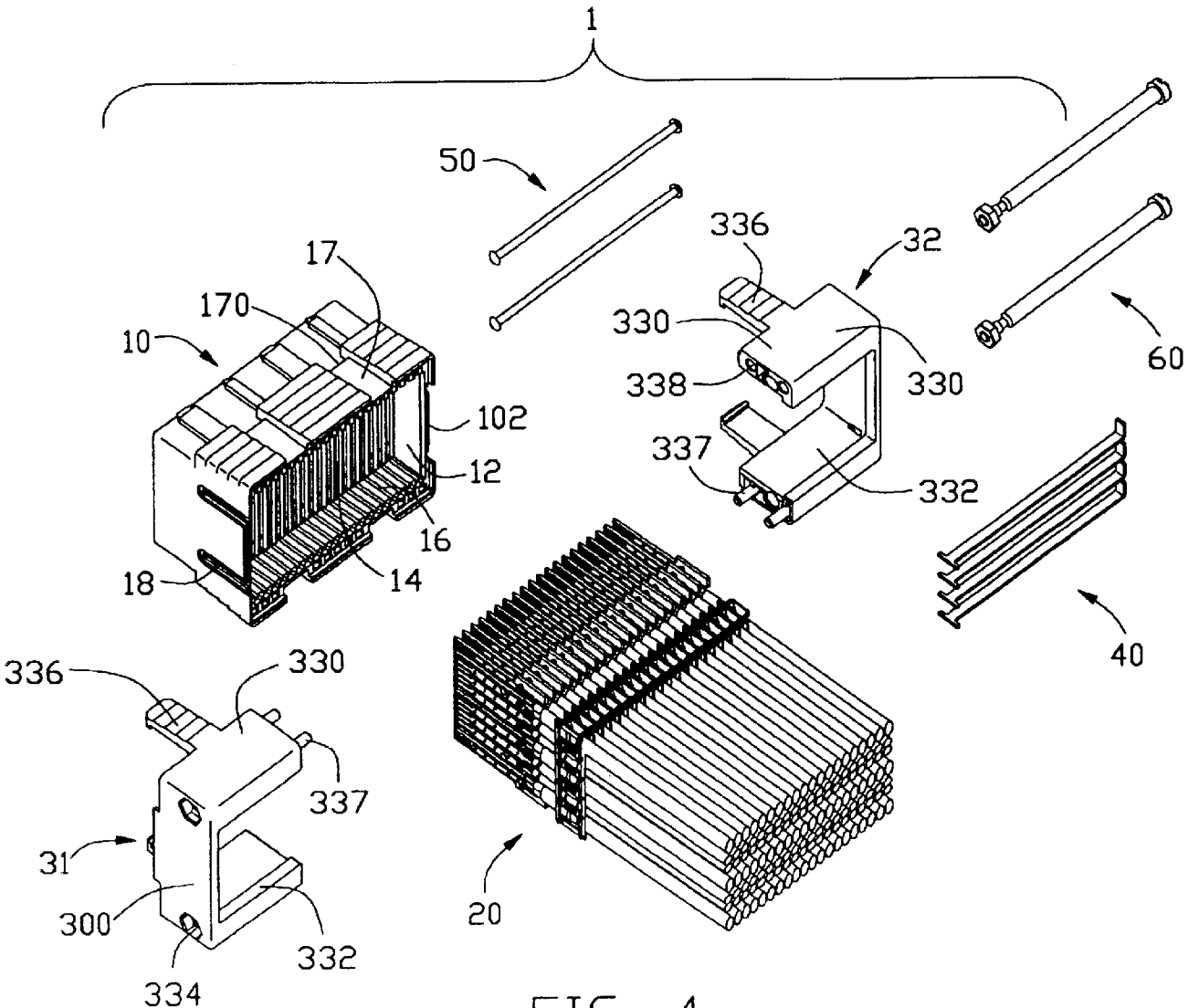
FIG. 4 is a view similar to FIG. 3, but taken from rear and bottom aspects.

Referring to FIGS. 3 and 4, the front housing 10 is generally in a rectangular shape. The housing 10 has a front mating port 111 in a front mating face 100 thereof which faces a complementary connector (not shown) and a rear chamber 12 in a rear face 102 thereof. The housing 10 defines a plurality of parallel channels 14 extending in a front-to-back direction communicating with the front mating port 11 and the rear chamber 12 and a plurality of grooves 16 which are aligned with the channels 14. The housing 10 further defines a plurality of recesses 17 respectively in a top face 104 and a bottom face (not labeled) and a plurality of depressions 170 recessed downwardly from the corresponding recesses 17. An aperture 18 is defined through opposite side faces 106 of the housing 10 in a direction substantially perpendicular to the extending direction of the channels 14.

Continuing to FIGS. 3 and 4, and in conjunction with FIGS. 1 and 2, the rear cover 30 comprises a split body having a first half 31 and a second half 32. Each half 31, 32 has a top panel 330, a bottom panel 332 and a side panel 334 formed between the top panel 330 and the bottom panel 332. Each half 31, 32 forms a pair of latches 336 extending forwardly from front edges of the top and bottom panels 330, 332, a plurality of dowel pins 337 and corresponding holes 338 for joining the first half 31 and the second half 32 together. Each latch 336 has a projection 3360 formed at a free end thereof. The rear cover 30 defines a bore 300 extending through the side panels 334 thereof. It should be noted that any other suitable connecting means may be employed to connect the first and second halves 31, 32. This split design helps to facilitate the assembly and installation of the cover 30 onto the housing 10 over the circuit modules 20. Understandably, the first and the second halves 31, 32 can be integrally formed with each other before assembling to the housing 10, if desired.

The circuit modules 20 are identical with each other in structure thereof and an exemplary one is shown in FIGS. 5–8. Each circuit module 20 comprises a circuit board 22 and a plurality of cables 23 electrically and mechanically connecting with the circuit board 22. The circuit board 22 includes a dielectric substrate made of conventional circuit board substrate material, a plurality of conductive first and second signal traces 221, 225 on one side of the substrate for providing electrical paths through the cable assembly 1 and a plurality of grounding traces 223 on both sides of the substrate for grounding purpose. Each circuit board 22 comprises a front edge portion 220 provided for engaging with the complementary mating connector and a rear edge portion 224 to which the cables 23 are mechanically connected. A through hole 222 is provided on the circuit board 22 which aligns with the aperture 18 of the housing 10 and a plurality of vias 226 are defined adjacent to the rear edge portion 224.

The cables 23 of each circuit module 20 comprise a plurality of first cables 231 and a plurality of second cables 232. Each first cable 231 consists of a differential pair of wires 2310 and a grounding core 2312 located beside the differential pair 2310. Each wire 2310 of the differential pair comprises a first conductive core 2314 surrounded by a first dielectric layer (not labeled). Each second cable 231 is a single-ended coaxial cable and comprises a second conductive core 2320 surrounded by a second dielectric layer (not labeled), a metal braid 2322 outside the dielectric layer, and a second insulated jacket 2324 at the outmost side of the second cable 232. At a distal end of each cable 231, 232, a length of dielectric layer is stripped to expose a corresponding length of conductive core 2314, 2320. The bare conductive cores 2314, 2320 of the first and the second cables 231, 232 are respectively soldered to the first and the second signal traces 221, 225 on the circuit board 22 from one side thereof. The grounding cores 2312 of the first cables 231 are respectively soldered to the grounding traces 223 on the circuit board from one side thereof. As can be best seen in FIGS. 6 and 8, in the preferred embodiment, a pair of second cables 232 are arranged side by side to form a subgroup. The subgroups and the first cables 231 of each circuit module 20 are arranged alternately with a gap 27 being defined therebetween.

With reference to FIGS. 5–8, the circuit module 20 also comprises a grounding plate 24 and a cable clamp 25 adapted for being applied to the cables 23. The grounding plate 24 is preferably a copper tape and is formed with a plurality of tabs 242 positioned at a periphery thereof. The grounding plate 24 is attached to the circuit board 22 from a side opposite to the conductive cores 231 of the cables 23 with the tabs 242 retained in the vias 226 of the circuit board 22 to thereby secure the grounding plate 24 thereon.

The cable clamp 25 includes a first section 251 and a second section 252 both are stamped and formed from metal tapes. The first section 251 defines a plurality of rooms 253 and forms a plurality of bridges 254 between adjacent rooms 253. Each bridge 254 defines a pair of openings 255 at opposite ends thereof. The second section 252 includes a body portion 256 and two rows of tails 257 upwardly extending from two opposite sides of the body portion 256. The first and second sections 251, 252 clamp ends of the cables 23 from opposite sides with the tails 257 of the second section 252 being locked in corresponding openings 255 of the first section 251. The ends of the cables 23 are depressed by the body portion 256 of the second section 252 such that they are partially pressed into corresponding rooms 253 of the first section 251. The first and second sections 251, 252 further define a plurality of through holes 266 which are aligned with corresponding gaps 27 between adjacent pairs of cables 23 of a same group.

Figure 5:
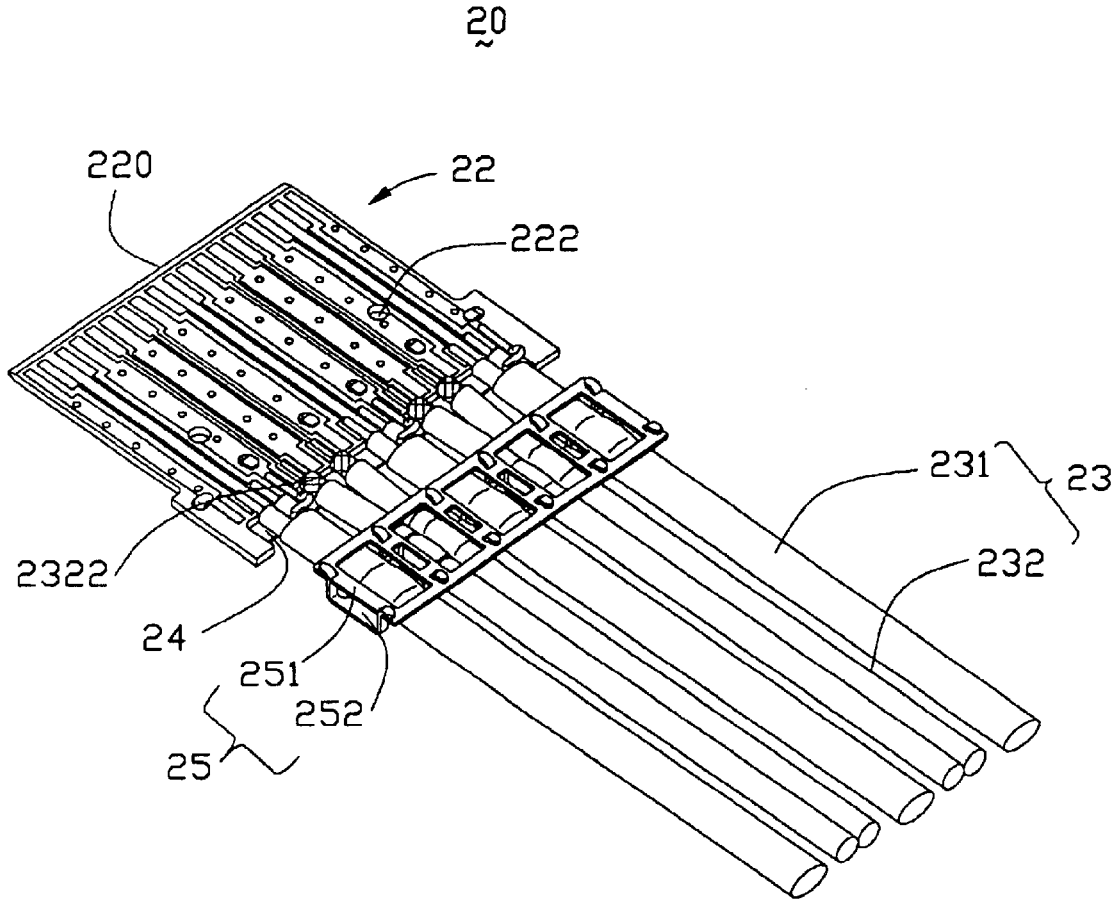
FIG. 5 is a perspective view of a circuit module.
Figure 6:
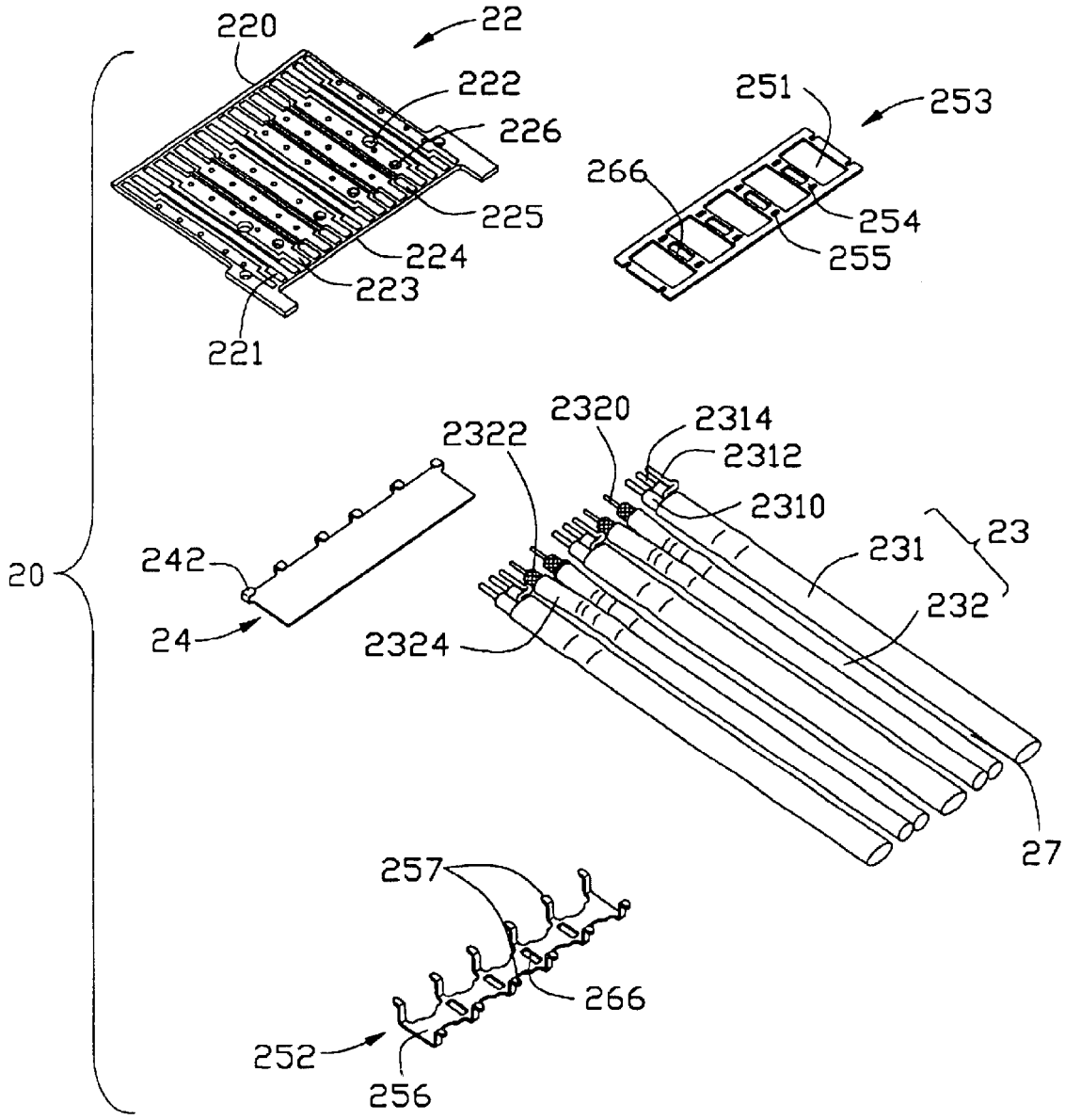
FIG. 6 is an exploded, perspective view of the circuit module shown in FIG. 5.
Figure 7:
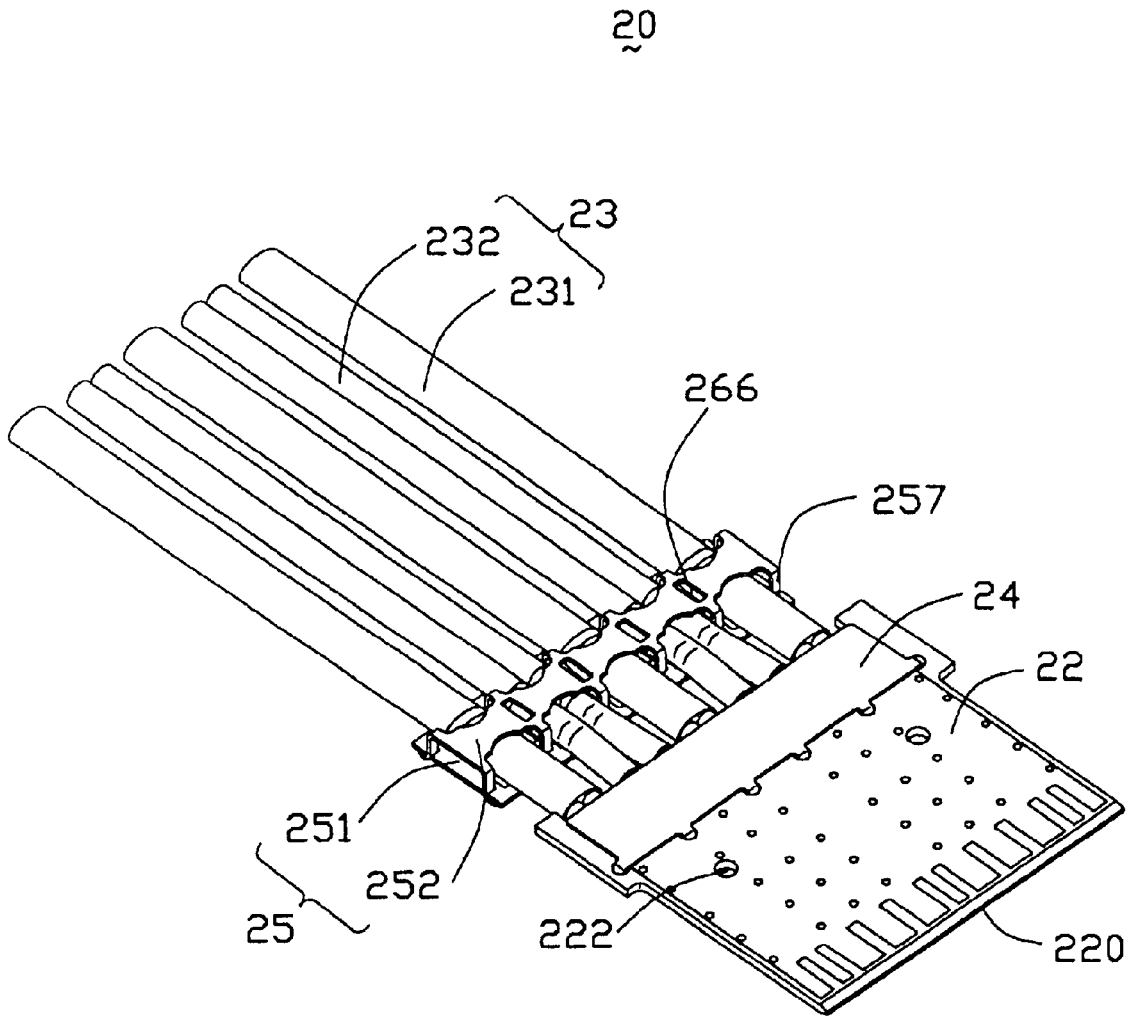
FIG. 7 is a view similar to FIG. 5, but taken from front and bottom aspects.
Figure 8:
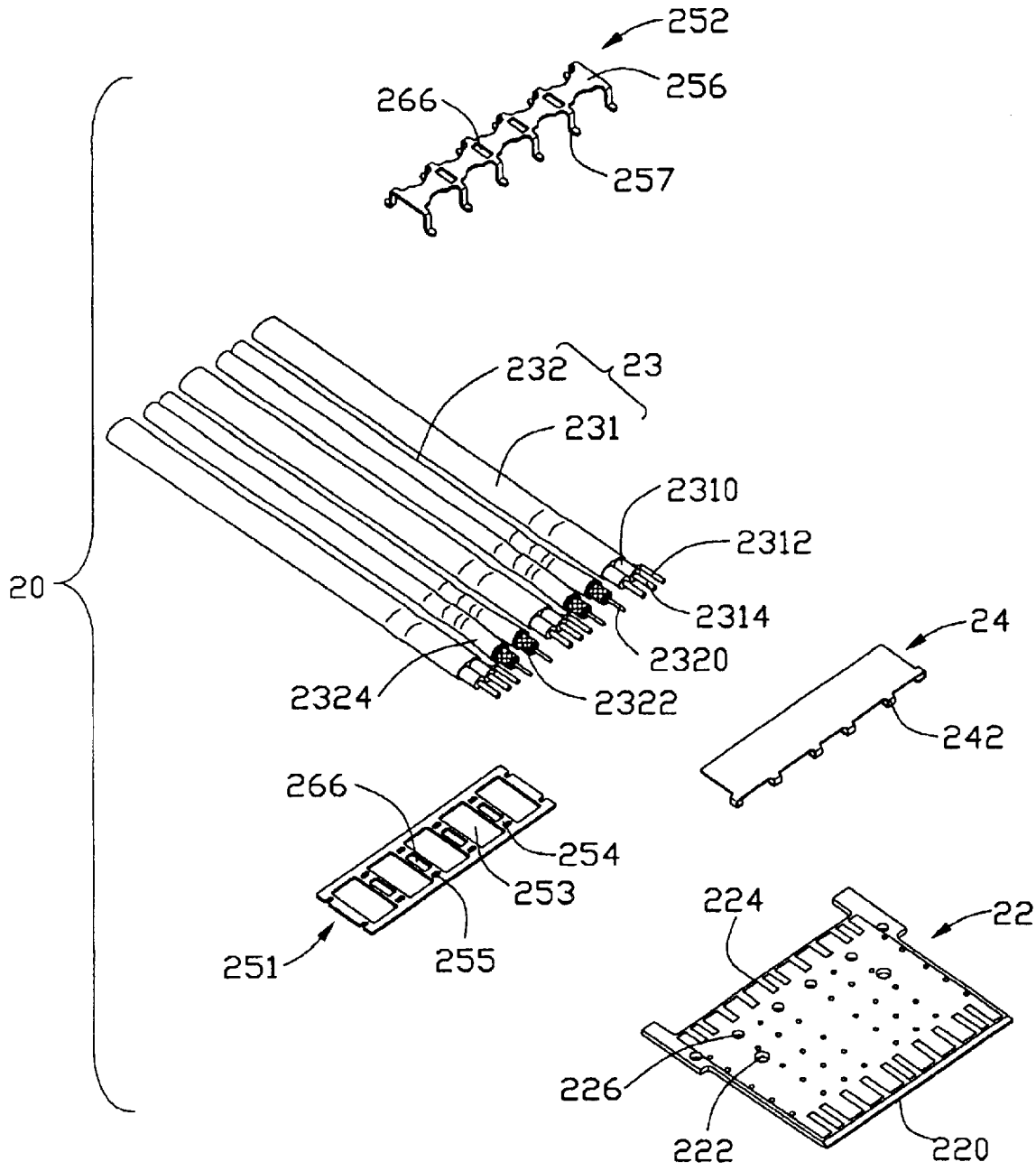
FIG. 8 is an exploded, perspective view of the circuit module shown in FIG. 7.
Figure 9:
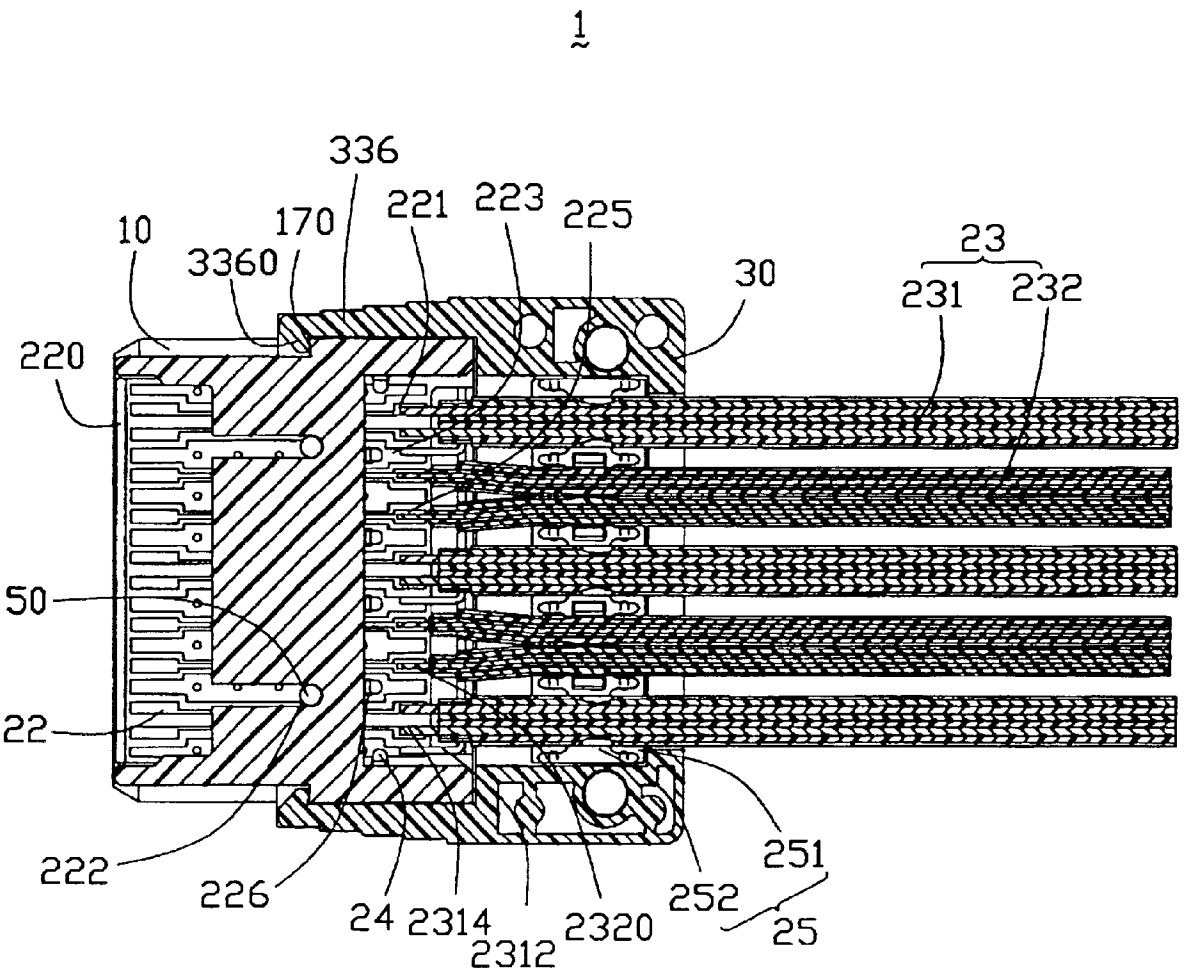
FIG. 9 is a cross-sectional view of the cable assembly taken along line 9—9 of FIG. 1.

Particularly referring to FIG. 9 in conjunction with FIGS. 5–6, an end of each second cable 232 is stripped to further expose a length of braid 2322, the exposed braid 2322 being soldered to the grounding plate 24 attached on an opposite side of the circuit board 22 to provide not only a grounding function but a strain relief function for the second cable 232.

In assembly, referring to FIGS. 1 and 2, the circuit modules 20 are inserted into the channels 14 of the housing 10 from the rear face 102 with the circuit boards 22 being substantially retained in the grooves 16. First fastening elements 40 are inserted into the through-holes 266 of the cable clamps 25 for locking the circuit modules 20 together for strain relief purpose. A second fastening element 50 is inserted into holes 222 defined in the circuit boards 22 through the aperture 18 of the housing 10. The second fastening element 50 is further fastened to the housing 10 for keeping the circuit modules 20 in their original positions rather than be pushed back when the cable assembly 1 mates with the complementary connector, thereby stably retaining the circuit modules 20 in the housing 10.

The first and second halves 31, 32 of the cover 30 are assembled to the housing 10 with the projections 3360 of the latches 336 mechanically engage the depressions 170 of the recesses 17. At the same time, the first and second halves 31, 32 are connected by an interference engagement between the dowel pins 337 and the corresponding recesses 338. A third fastening element 60 is inserted into the bore 300 of the cover 30 for retaining the circuit modules 20 in the cover 30.

It is noted that since the circuit modules 20 are stably retained by the front housing 10 and the rear cover 30 via the second and third fastening elements 50, 60, a reliable electrical engagement is ensured between the cable assembly 1 and the complementary connector. It is also noted that the cables 23 are clamped by the cable clamps 25, more importantly, the cable clamps 25 are locked together via the first fastening element 40, whereby a pulling force exerted on the cables 23 can be substantially released. Additionally, the cables 23 is composed of a plurality of first cables which transmits relatively high speed signals and a plurality of second cables which transmits relatively low speed signals via soldering to the signal and grounding traces 221, 225 and 223 of the circuit board 22. Thus, the cable assembly 1 can transmit different kinds of signals therethrough.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable assembly comprising:

an insulative housing comprising a plurality of chamnels and an aperture extending along a direction perpendicular to the channels;

a plurality of recesses respectively in a top face and a bottom face of the housing, and a plurality of depressions recessed downwardly from the corresponding recesses a plurality of circuit modules each comprising a circuit board retained in a corresponding channel of the housing and defining therethrough a hole aligned with the aperture of the housing, a plurality of first and second cables electrically connecting to one side of the circuit board, and a grounding plate attached to an opposite side of the circuit board, each second cable being electrically connected with the grounding plate;

a cover comprising first and second halves jointed together and being attached to the housing, the cover defining a bore extending through the first and second halves wherein each half forming a pair of latches which extending forwardly from front edges of a top panel and a bottom panel for engaging with the depressions of the housing, and a plurality of dowel pins and corresponding holes disposed in the each half for joining the first and second halves together; and first and second fastening elements respectively inserted into the holes of the circuit boards through the aperture of the housing and the bore of the cover for retaining the circuit modules in their original positions.

2. The cable connector assembly as claimed in claim 1, wherein each circuit board defines a plurality of vias and the grounding plate has a plurality of tabs retained in corresponding vias of the circuit board.

3. The cable connector assembly as claimed in claim 2, wherein each circuit module further comprises a cable clamp binding the cables together.

4. The cable connector assembly as claimed in claim 3, further comprising a third fastening element, and the cable clamp defines a through hole therein for insertion of the fastening element.

5. The cable connector assembly as claimed in claim 3, wherein the cable clamp comprises a first and a second stamped metallic sections clamping the coaxial cables from opposite sides.

* * * * *